US009936812B2

(12) United States Patent
Kessler

(10) Patent No.: US 9,936,812 B2
(45) Date of Patent: Apr. 10, 2018

(54) LEG SUPPORT ASSEMBLY

(71) Applicant: Frances Kessler, Greenwood, IN (US)

(72) Inventor: Frances Kessler, Greenwood, IN (US)

( * ) Notice: Subject to any disclaimer, the term of this patent is extended or adjusted under 35 U.S.C. 154(b) by 0 days.

(21) Appl. No.: 15/692,220

(22) Filed: Aug. 31, 2017

(65) Prior Publication Data

US 2017/0360208 A1 Dec. 21, 2017

Related U.S. Application Data

(63) Continuation-in-part of application No. 15/048,343, filed on Feb. 19, 2016, now abandoned.

(51) Int. Cl.

| | |
|---|---|
| ***A47C 20/02*** | (2006.01) |
| ***A61G 7/075*** | (2006.01) |
| ***A47C 20/00*** | (2006.01) |

(52) U.S. Cl.

CPC ..... *A47C 20/021* (2013.01); *A61G 7/0755* (2013.01); *A61G 2200/32* (2013.01)

(58) Field of Classification Search

CPC ..... A61G 13/1245; A61G 13/1235; A61G 13/12; A61G 13/1205; A61G 13/121; A61G 13/122; A61G 13/1225; A61G 13/123; A61G 13/125; A61G 7/07; A61G 7/072; A61G 7/075; A61G 7/0755; A47C 20/021

USPC ... 5/648, 646, 640, 643, 632, 630, 621–624, 5/652, 657

See application file for complete search history.

(56) References Cited

U.S. PATENT DOCUMENTS

| | | | | |
|---|---|---|---|---|
| 2,197,343 | A * | 4/1940 | Marx | A47G 9/1009 248/436 |
| 2,502,752 | A * | 4/1950 | Richards | A47C 20/021 5/507.1 |
| 2,551,388 | A * | 5/1951 | Nygard | A47C 20/021 5/640 |
| 2,581,110 | A * | 1/1952 | Kenworthy | A61G 7/0755 248/394 |
| 3,066,322 | A | 12/1962 | Derby | |
| 3,159,141 | A | 12/1964 | Paterek | |
| 3,430,956 | A | 3/1969 | Borgeas | |
| 4,544,203 | A * | 10/1985 | Younger | A47G 9/1009 108/118 |
| 5,279,530 | A | 1/1994 | Hess | |
| D440,717 | S | 4/2001 | Fazio | |
| 6,626,408 | B1 | 9/2003 | Lorbiecki et al. | |
| 6,718,581 | B2 | 4/2004 | Riach | |

(Continued)

FOREIGN PATENT DOCUMENTS

WO WO2006084393 8/2006

*Primary Examiner* — Robert G Santos

(57) ABSTRACT

A leg support assembly includes a lower frame including a pair of arms orientated parallel to each other. A pad is attached to the arms. An upper frame has an open end and an open central area. The open end is directed towards the pad. A plane of the upper frame is orientated parallel to a plane of the lower frame. A flexible material is attached to the upper frame and extends across the open central area. The flexible material supports an elevated leg of a person. A plurality of supports is attached to and extends between the upper and lower frames and retains the upper frame vertically above the lower frame. The plurality of supports is hingedly coupled to the lower and upper frames to allow lowering or raising of the upper frame relative to the lower frame.

6 Claims, 4 Drawing Sheets

(56) References Cited

U.S. PATENT DOCUMENTS

| | | | | |
|---|---|---|---|---|
| 6,764,458 | B2 * | 7/2004 | Polonchek | A61G 7/0755 128/845 |
| 6,839,927 | B1 * | 1/2005 | Crane | A47G 9/10 5/639 |
| 6,874,184 | B2 * | 4/2005 | Chandler | A47C 16/02 128/845 |
| 7,156,820 | B2 * | 1/2007 | Polonchek | A61G 7/0755 128/845 |
| 8,485,952 | B2 | 7/2013 | Gehrke | |
| 8,572,781 | B2 * | 11/2013 | Schlanger | A61F 5/3761 5/646 |
| 8,850,642 | B2 * | 10/2014 | Rasmussen | A47G 9/1027 297/398 |
| 2002/0184706 | A1 * | 12/2002 | Riach | A47D 13/063 5/99.1 |
| 2004/0059268 | A1 * | 3/2004 | Polonchek | A61G 7/0755 601/33 |
| 2004/0204668 | A1 * | 10/2004 | Polonchek | A61G 7/0755 602/32 |
| 2004/0255384 | A1 | 12/2004 | Chandler | |
| 2011/0000022 | A1 * | 1/2011 | Schlanger | A61F 5/3761 5/630 |
| 2013/0276236 | A1 | 10/2013 | Rasmussen | |
| 2017/0239114 | A1 * | 8/2017 | Kessler | A61G 7/0755 |
| 2017/0360208 | A1 * | 12/2017 | Kessler | A47C 20/021 |

* cited by examiner

LEG SUPPORT ASSEMBLY

CROSS-REFERENCE TO RELATED APPLICATIONS

This application is a continuation-in-part and claims priority of application Ser. No. 15/048,343 filed Feb. 19, 2016.

BACKGROUND OF THE DISCLOSURE

Field of the Disclosure

The disclosure relates to leg vertical support devices and more particularly pertains to a new leg vertical support device for comfortably elevating a leg to promote healing and reduce swelling.

SUMMARY OF THE DISCLOSURE

An embodiment of the disclosure meets the needs presented above by generally comprising a lower frame including a pair of arms and a center member that is attached to and extends between the pair of arms. The arms are orientated parallel to each other. A pad is attached to the arms. The pad has a top side and a bottom side. An upper frame has an open end and an open central area. The open end is directed towards the pad. A plane of the upper frame is orientated parallel to a plane of the lower frame. A flexible material is attached to the upper frame and extends across the open central area. The flexible material is configured to support a leg of a person. A plurality of supports is attached to and extends between the upper and lower frames and retains the upper frame vertically above the lower frame. The plurality of supports is hingedly coupled to the lower and upper frames to allow lowering or raising of the upper frame relative to the lower frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
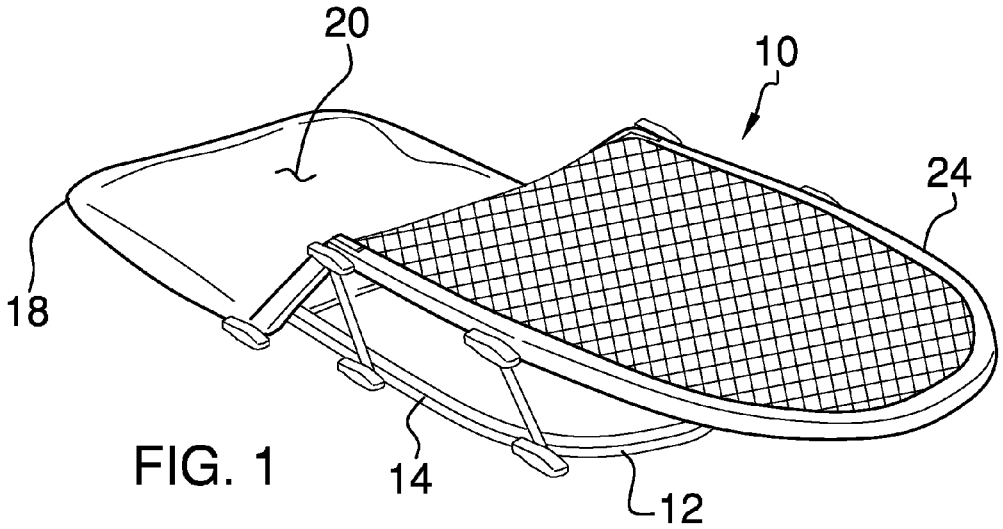
FIG. 1 is a top perspective view of a leg support assembly according to an embodiment of the disclosure.
Figure 2:
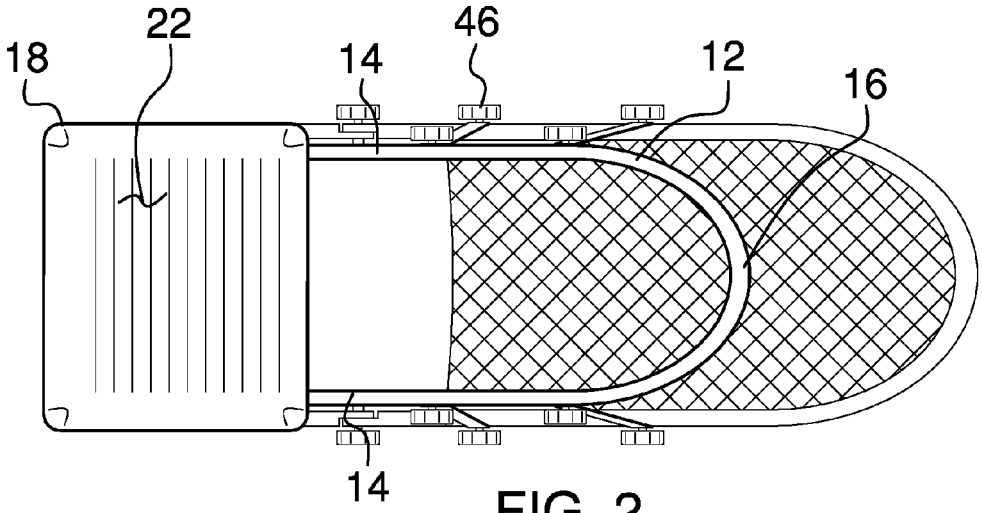
FIG. 2 is a bottom view of an embodiment of the disclosure.
Figure 3:
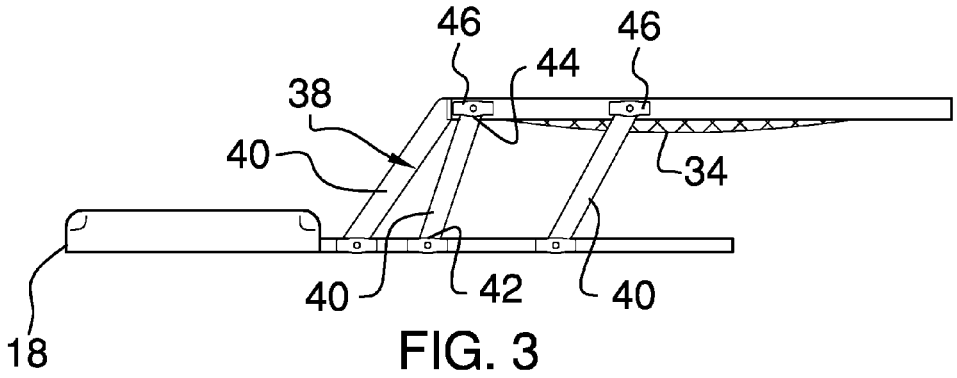
FIG. 3 is a side view of an embodiment of the disclosure.
Figure 4:
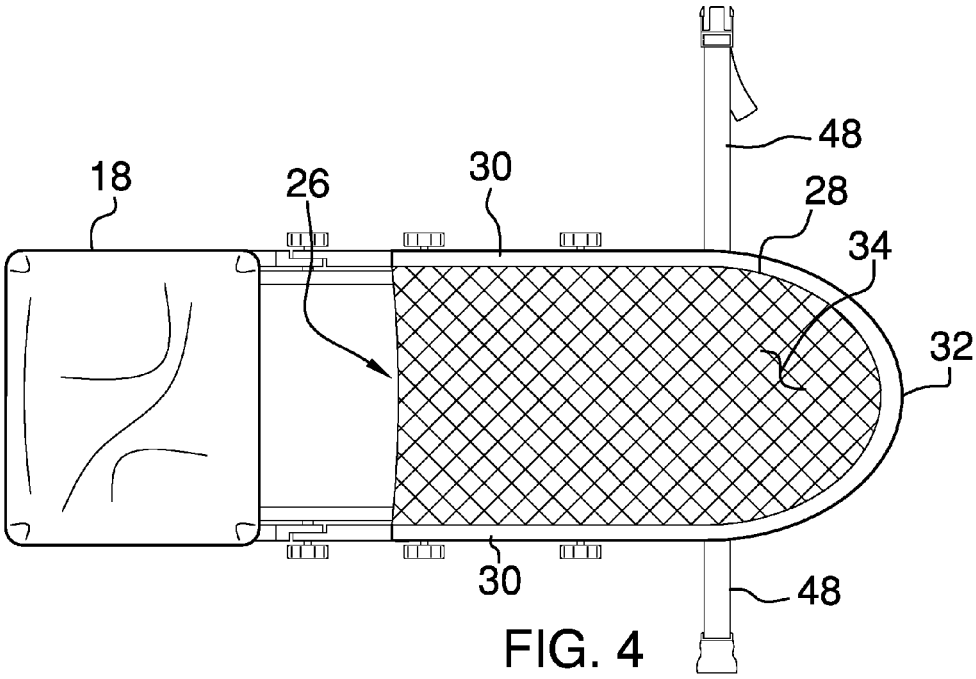
FIG. 4 is a top view of an embodiment of the disclosure.

With reference now to the drawings, and in particular to FIGS. 1 through 7 thereof, a new leg vertical support device embodying the principles and concepts of an embodiment of the disclosure and generally designated by the reference numeral 10 will be described.

Figure 5:
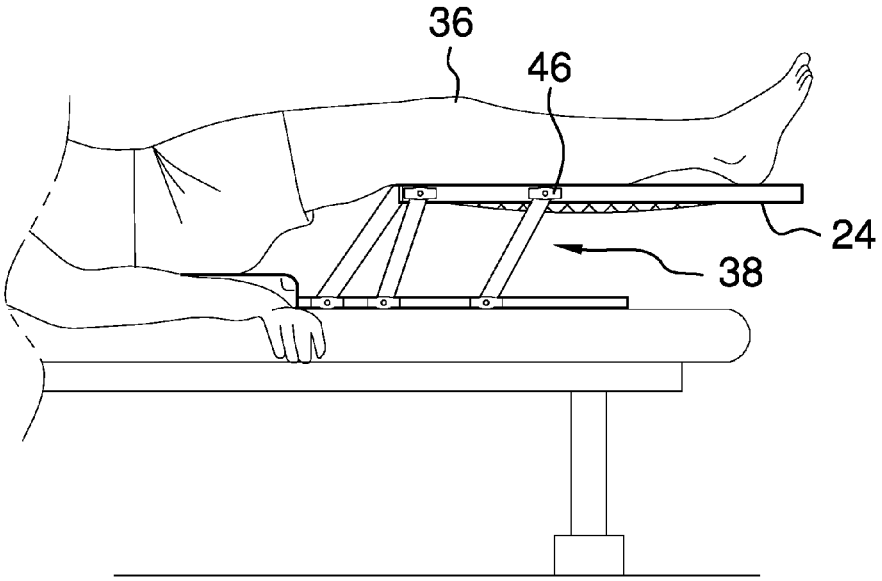
FIG. 5 is a side in-use view of an embodiment of the disclosure.
Figure 6:
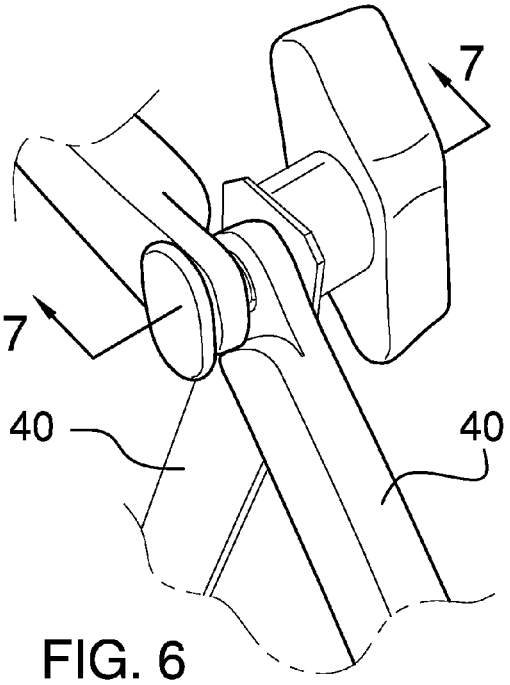
FIG. 6 is a perspective enlarged view of a support of an embodiment of the disclosure.
Figure 7:
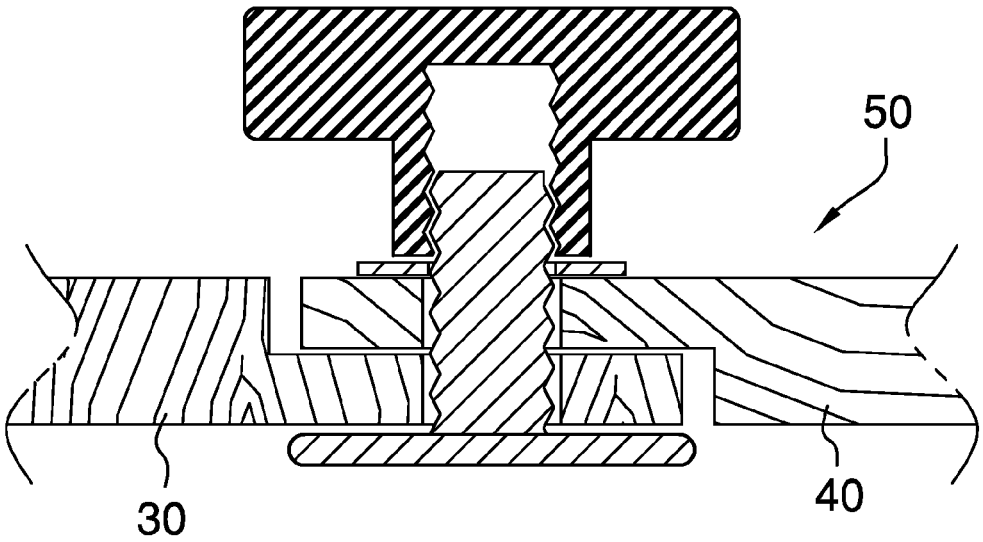
FIG. 7 is a cross-sectional view of an embodiment of the disclosure taken along line 7-7 of FIG. 6.

As best illustrated in FIGS. 1 through 7, the leg support assembly 10 generally comprises a lower frame 12 including a pair of arms 14 and a center member 16 that is attached to and extends between the pair of arms 14. The arms 14 are orientated parallel to each other. The lower frame 12 has a length less than 4.0 feet. A pad 18 is attached to the arms 14 and has a top side 20 and a bottom side 22. The pad 18 is comprised of a resiliently compressible material and is configured to be laid upon as shown in FIG. 5. The pad 18 may be positioned distal to the center member 16. The bottom side 22 may include a non-slip surface to prevent its easy movement on a bed, table or other surface.

An upper frame 24 has an open end 26 and an open central area 28. The open end 26 is directed towards the pad 18. A plane of the upper frame 24 is orientated parallel to a plane of the lower frame 12. The upper frame 24 includes a U-shaped member having a pair of elongated members 30 and a central member 32 that is attached to and extends between the elongated members 28. Each elongated member 30 is generally aligned with one of the arms 14. A flexible material 34 is attached to the upper frame 24 and extends across the open central area 28. The flexible material 34 is configured to support a leg 36 of a person when the leg 36 is positioned in the open central area 28. The flexible material 34 may particularly comprise a netting having a plurality of openings extending therethrough to facilitate airflow through the flexible material 34. The flexible material 34 may extend downwardly and be attached to or adjacent to the pad 18.

A plurality of supports 38 is attached to and extends between the upper 24 and lower 12 frames and retains the upper frame 24 vertically above the lower frame 12. The plurality of supports 38 is hingedly coupled to the lower 12 and upper 24 frames to allow lowering or raising of the upper frame 24 relative to the lower frame 12 while maintaining the upper frame being parallel to the lower frame during raising and lowering of the upper frame relative to the lower frame. The supports 38 each include a post 40 having a lower end 42 pivotally coupled to the lower frame 12 and an upper end 44 pivotally coupled to the upper frame 24. The posts 40 are equal in length and spaced such that the upper frame remains parallel to the lower frame as the posts are pivoted. A plurality of locking members 50, such as conventional threaded knobs used to tighten the supports 38 against the upper 24 and lower 12 frames, is mounted on the supports 38 and releasably secures the supports 38 relative to the upper frame 24 and may be also be used to secure the supports 38 relative to the lower frame 12. The upper frame 24 is positioned so that it is not located over the pad 18 but moved away therefrom during the usage of the assembly 10.

In use, the assembly 10 would typically be laid upon a bed for a patient with a leg injury. The leg 36 would be positioned on the upper frame 24 after the upper frame 24 was positioned at desired elevation relative to the lower frame 12. The leg 36, once placed on the flexible material, could be held in place with a strap 48, if needed, attached to the upper frame 24. The strap 48, shown only in FIG. 4, may comprise any conventional strap and coupler combination to facilitate retention of the leg 36 on the flexible material 34. The flexible material 34, which may be resiliently elastic, will comfortably cradle the leg 36 while allowing good airflow around the leg 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A leg support assembly configured for supporting an elevated leg of person while the person is in a lying position, said assembly comprising:

a lower frame including a pair of arms and a center member being attached to and extending between said pair of arms, said arms being orientated parallel to each other;

a pad being attached to said arms, said pad having a top side and a bottom side;

an upper frame having an open end and an open central area, said open end being directed towards said pad, a plane of said upper frame being orientated parallel to a plane of said lower frame;

a flexible material being attached to said upper frame and extending across said open central area, said flexible material being configured to support a leg of a person; and a plurality of supports being attached to and extending between said upper and lower frames and retaining said upper frame vertically above said lower frame, said plurality of supports being hingedly coupled to said lower and upper frames to allow lowering or raising of said upper frame relative to said lower frame while maintaining said upper frame being parallel to said lower frame during raising and lowering of said upper frame relative to said lower frame.

2. The leg support assembly according to claim 1, wherein said pad is comprised of a resiliently compressible material.

3. The leg support assembly according to claim 1, wherein said upper frame includes a U-shaped member having a pair of elongated members and a central member being attached to and extending between said elongated members.

4. The leg support assembly according to claim 1, wherein said flexible material comprises a netting having a plurality of openings extending therethrough to facilitate airflow through said flexible material.

5. The leg support assembly according to claim 1, wherein said supports each include a post having a lower end pivotally coupled to said lower frame and an upper end pivotally coupled to said upper frame, each of said posts being equal in length and spaced such that said upper frame remains parallel to said lower frame as said posts are pivoted, a plurality of locking members being mounted on said supports and releasably securing said supports relative to said upper frame.

6. A leg support assembly configured for supporting an elevated leg of person while the person is in a lying position, said assembly comprising:

a lower frame including a pair of arms and a center member being attached to and extending between said pair of arms, said arms being orientated parallel to each other;

a pad being attached to said arms, said pad having a top side and a bottom side, said pad being comprised of a resiliently compressible material;

an upper frame having an open end and an open central area, said open end being directed towards said pad, a plane of said upper frame being orientated parallel to a plane of said lower frame, said upper frame including a U-shaped member having a pair of elongated members and a central member being attached to and extending between said elongated members;

a flexible material being attached to said upper frame and extending across said open central area, said flexible material being configured to support a leg of a person, said flexible material comprising a netting having a plurality of openings extending therethrough to facilitate airflow through said flexible material; and a plurality of supports being attached to and extending between said upper and lower frames and retaining said upper frame vertically above said lower frame, said plurality of supports being hingedly coupled to said lower and upper frames to allow lowering or raising of said upper frame relative to said lower frame while maintaining said upper frame being parallel to said lower frame during raising and lowering of said upper frame relative to said lower frame, said supports each including a post having a lower end pivotally coupled to said lower frame and an upper end pivotally coupled to said upper frame, each of said posts being equal in length and spaced such that said upper frame remains parallel to said lower frame as said posts are pivoted, a plurality of locking members being mounted on said supports and releasably securing said supports relative to said upper frame.

* * * * *